United States Patent [19]

Eburn, Jr. et al.

[11] 4,321,014

[45] Mar. 23, 1982

[54] CONSTANT FLOW PUMPING APPARATUS

[75] Inventors: William H. Eburn, Jr., Sudbury, Mass.; Stephen P. Kalenik, Merrimack, N.H.

[73] Assignee: Polaroid Corporation, Cambridge, Mass.

[21] Appl. No.: 108,700

[22] Filed: Dec. 31, 1979

[51] Int. Cl.[3] ..... F04B 41/06

[52] U.S. Cl. ..... 417/5; 417/27; 417/29; 417/53; 417/317

[58] Field of Search ..... 417/317, 316, 2–8, 417/53, 26, 27, 29

[56] References Cited

U.S. PATENT DOCUMENTS

| | | | |
|---|---|---|---|
| 2,178,396 | 10/1939 | Landenberger | 417/317 |
| 3,025,803 | 3/1962 | Swarthout . | |
| 3,347,418 | 10/1967 | Fefferman . | |
| 3,488,763 | 1/1970 | Lofquist . | |
| 4,127,360 | 11/1978 | Carpenter | 417/5 |

FOREIGN PATENT DOCUMENTS

| | | | |
|---|---|---|---|
| 55-43270 | 3/1980 | Japan | 417/317 |

*Primary Examiner*—Carlton R. Croyle
*Assistant Examiner*—Edward Look
*Attorney, Agent, or Firm*—John J. Kelleher

[57] ABSTRACT

A multiple pumping chamber pump in which the pressures in at least two of said chambers are equal for at least a portion of their pumping cycles, maintains a constant flow of pumped material by utilizing control means that selectively and continually replaces one material pumping chamber with another after the pressures in both of said chambers have equalized and after the outputs of said chambers have been connected to a common output conduit, by gradually and simultaneously causing a decrease in the pumping rate of material from one of said compression chambers and, to the same extent, a corresponding increase in the pumping rate of material from another of said chambers until the material pumping rate from one of said chambers is reduced from its normal pumping rate to zero and the pumping rate from the other of said chambers has been increased to the said normal pumping rate from the said chamber that had its flow rate reduced to zero.

12 Claims, 4 Drawing Figures

CONSTANT FLOW PUMPING APPARATUS

BACKGROUND OF THE INVENTION

1. Field of the Invention

The present invention relates to pumping apparatus that minimizes variations in the flow rate of the material that it pumps, in general, and to such apparatus for so controlling the flow rate of a coating fluid, in particular.

2. Description of the Prior Art

In the operation of present-day coating apparatus where coatings of critical thickness are desired to be deposited upon a substrate such as a moving web for use in photographic film, it is necessary to precisely control the flow rate of liquid coating material from a liquid storage reservoir to a coating applicator such as an extrusion coater, which is one device that applies coating material to such a web. An extremely important factor in the control of coating thickness and variations in coating thickness is the control of the flow rate of the material of which said coating is formed, as said coating is being deposited on a substrate.

One piece of apparatus is present use that is able to control the flow rate of coating materials to within acceptable limits utilizes a substantially overpressurized coating material reservoir that has means for regulating the pressure of the coating material flowing from said reservoir. While this type of apparatus will produce a relatively smooth flow rate of material, the flow is not steady due to the limited capacity of such reservoirs. If the flow rate of the material being deposited on a substrate could be maintained for extended periods of time, the production rate of coated finished products such as photographic film, would be substantially increased.

Apparatus for pumping semifluid materials such as a plaster mixture or the like from a reservoir to a use point are presently available. In one system, which is described in U.S. Pat. No. 3,025,803 To SWARTHOUT, a pair of cylinder/piston pumps, having overlapping pumping cycles, alternately deliver material to said use point. A problem with this type of pumping apparatus is the unacceptably high variations in the flow rate of the material being pumped during that portion of the pumping cycle where there is a changeover from one cylinder/piston pump to another, partially because of the suddenness of said changeover, and therefore such apparatus would be unable to provide the constant flow rate that is required in order to obtain the desired coating thickness mentioned above.

SUMMARY OF THE INVENTION

In accordance with the teachings of the present invention, pumping apparatus is provided that can deliver pumpable material at its output at a substantially constant flow rate. The pumping apparatus includes at least two pumping chambers with each of said pumping chambers having an inlet valve, a zero volume displacement outlet valve and pumping means having pumping cycles that overlap one another into which material flows, is subsequently pressurized and then is moved through their respective chamber outlets. Means are provided for determining the pressures in each of said chambers and then connecting their outlets to a common conduit without displacing said pumpable material after the pressure in each of said chambers are equal. Means are also provided for cyclically changing to a full pumping chamber from one that has been emptied to a predetermined level during said overlapping portion of their pumping cycles. The change is accomplished by gradually reducing the rate of movement of the pumping means in the pumping chamber that has been so emptied while simultaneously, and to the same extent, increasing the rate of movement of the pumping means of the full pumping chamber until the rate of movement of the pumping means in said emptied pumping chamber is reduced to zero and the rate of movement of the pumping means in said full pumping chamber has increased to what the rate of movement of the pumping means in said emptied pumping chamber was before its rate of movement was so reduced. It is primarily the combination of a zero volume displacing outlet valve and the simultaneous increase and decrease in the rate of movement of the movable or pumping member of the pumping means in each pumping chamber during the said overlapped portion of their pumping cycles that produces the said substantially constant rate of material flow from the output of said pumping apparatus.

DESCRIPTION OF THE PREFERRED EMBODIMENTS

Figure 1:
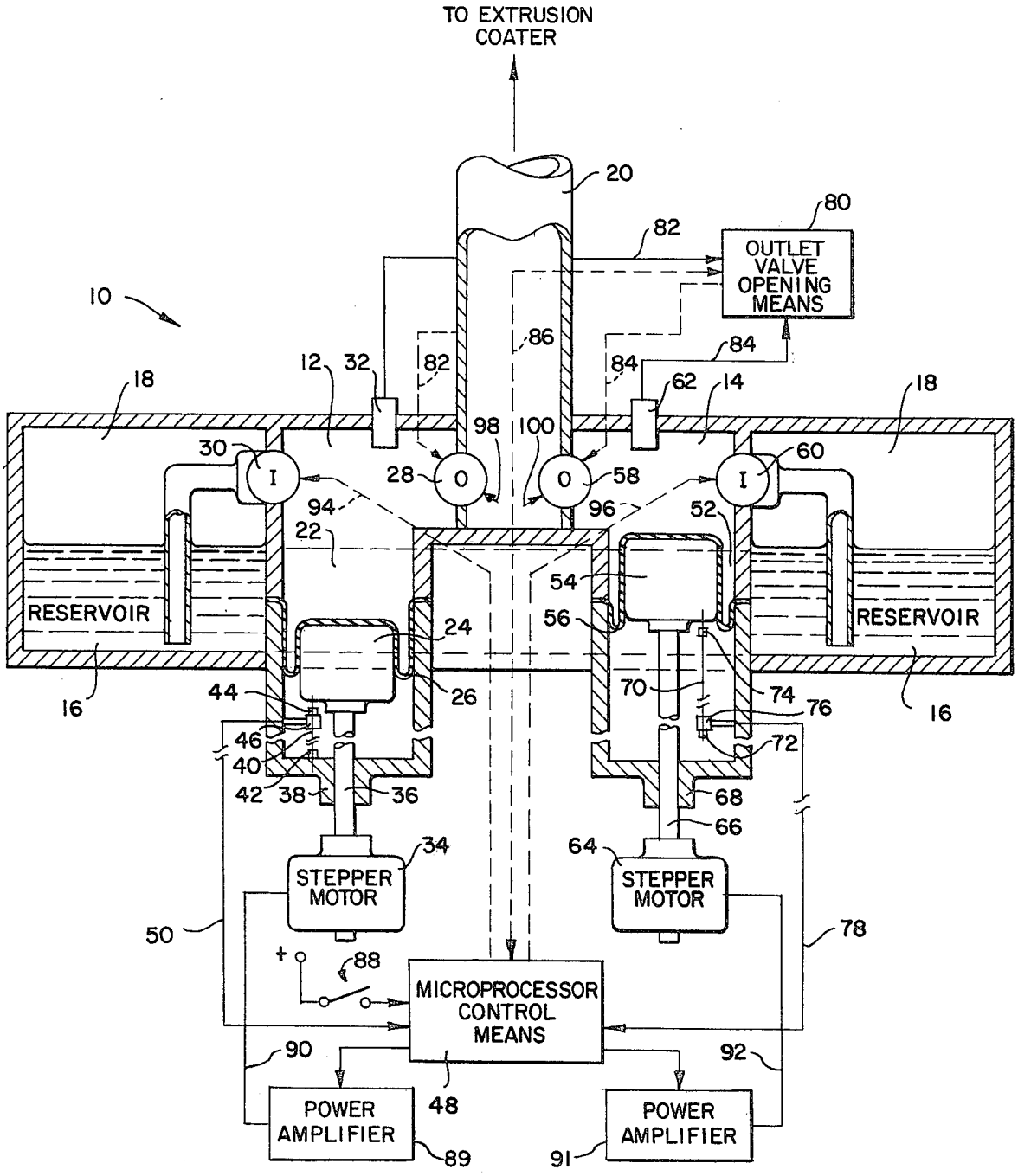
FIG. 1 is a schematic diagram of an elevational view, partially in section, of the substantially constant flow rate pumping apparatus of the present invention.

Referring now to the drawings, and specifically to FIG. 1, pumping apparatus 10 incorporating a preferred embodiment of the inventive concept of the present invention is depicted. Pumping apparatus 10 includes pumping chambers 12 and 14 into which pumpable material 16 flows from reservoir 18, is pressurized and then delivered to common conduit 20. Pumpable material flows out of the reservoir because said reservoir has a slightly positive pressure head. Pumping chamber 12 includes cylinder 22 into which pumping member or piston 24 and rolling seal 26 radially connected between said cylinder 22 and the end of said piston 24, have been fitted. Rolling seal 26 is of the type disclosed in U.S. Pat. No. 3,488,763 to LOSQUIST, JR., a device that minimizes friction between said piston 24 and said cylinder 22 and the contamination of material 16 as it is being pumped by pumping apparatus 10.

Pumping chamber 12 also includes outlet valve 28 for controlling the flow of material 16 from chamber 12 to common conduit 20, inlet valve 30 for controlling the flow of material 16 from reservoir 18 to pumping chamber 12 and pressure sensor 32 for sensing the pressure in pumping chamber 12. Outlet valve 28 is of the low shear, zero displacement type as described in my copending patent application Ser. No. 108699 filed on even date herewith and assigned to the assignee of the present invention. Reciprocating movement of piston 24 is generated by bidirectional stepper motor 34 which is coupled to said piston 24 by lead screw 36. Screw threads (not shown) in housing 38 cooperatively engage the threads (not shown) of lead screw 36. Reciprocating movement of piston 24 is produced when lead screw 36 is twisted in said cooperating threads in said housing 38 by stepper motor 34.

Rod 40 which is fixedly attached to and extends vertically downward from piston 24 has upper limit and lower limit microswitch actuators 42 and 44, respectively, that are attached to and project laterally outward from said rod 40. Piston travel sensor 46 includes a set of microswitches that are actuated when engaged by said actuators 42 and 44 at preselected travel positions of piston 24. Piston travel information produced by piston travel sensor 46 is routed to microprocessor control means 48 through path 50. The function of microprocessor control means 48 will be explained elsewhere herein.

Pumping chamber 14 includes cylinder 52 into which pumping member or piston 54 has been fitted, and rolling seal 56 which has the same function as rolling seal 26 described above with respect to pumping chamber 12.

Pumping chamber 14 also includes outlet valve 58 for controlling the flow of material 16 from chamber 14 to common conduit 20, inlet valve 60 for controlling the flow of material 16 from reservoir 18 to pumping chamber 14 and pressure sensor 62 for sensing the pressure in pumping chamber 14. Outlet valve 58 is of the low shear, zero displacement type described in my copending application cited above. Reciprocating movement of piston 54 is generated by bidirectional stepper motor 64 which is coupled to said piston 54 by lead screw 66. Screw threads (not shown) in housing 68 cooperatively engage the threads (not shown) of lead screw 66. Reciprocating movement of piston 54 is produced when lead screw 66 is twisted in said cooperating threads in said housing 68 by said stepper motor 64.

Rod 70 which is fixedly attached to and extends vertically downward from piston 54 has upper limit and lower limit microswitch actuators 72 and 74, respectively, that are attached to and project laterally outward from said rod 70. Piston travel sensor 76 includes a set of microswitches that are actuated when engaged by said actuators 72 and 74 at preselected travel positions of piston 54. Piston travel information produced by piston travel sensor 76 is routed to microprocessor control means 48 through path 78.

Pressure sensors 32 and 62 sense the pressures in chambers 12 and 14, respectively, and the pressure information produced by these sensors is routed to outlet valve opening means 80 through paths 82 and 84, respectively. Outlet valve opening means 80 is actually a part of microprocessor control means 48. However, for convenience only, opening means 80 and microprocessor control means 48 have been shown as separate entities. Outlet valve opening means 80 determines when the pressures in chambers 12 and 14 are equal and utilizes this information to open outlet valves 28 and 56, at the appropriate time, by sending valve opening signals through paths 82 and 84. Outlet valve opening means 80 also advises microprocessor control means 48 as to when the pressures in chambers 12 and 14, as sensed by sensors 32 and 62, are equal, by sending a signal that includes such information through path 86.

Microprocessor control means 48, which is connected to a source of electrical power (not shown) through switch 88, has preprogrammed control instructions incorporated therein for controlling the rate of rotation of stepper motors 34 and 64, for controlling the opening and closing of inlet valves 30 and 60, and for controlling the closing of outlet valves 28 and 58. Microprocessor control signals for stepper motors 34 and 64 are routed through power amplifier 89 and path 90, and power amplifier 91 and path 92, respectively; microprocessor control signals for controlling inlet valves 30 and 60 are routed through paths 94 and 96, respectively; and microprocessor control signals for controlling the closing of outlet valves 28 and 58 are routed through paths 98 and 100, respectively. The particular point in time when microprocessor control means 48 produces these control signals is dependent upon piston travel information provided by piston travel sensors 46 and 76 and chamber pressure information provided by outlet valve opening means 80. The sequence of operation or timing of these signals is best understood by additionally referring herein to FIGS. 2 and 3.

Figure 2:
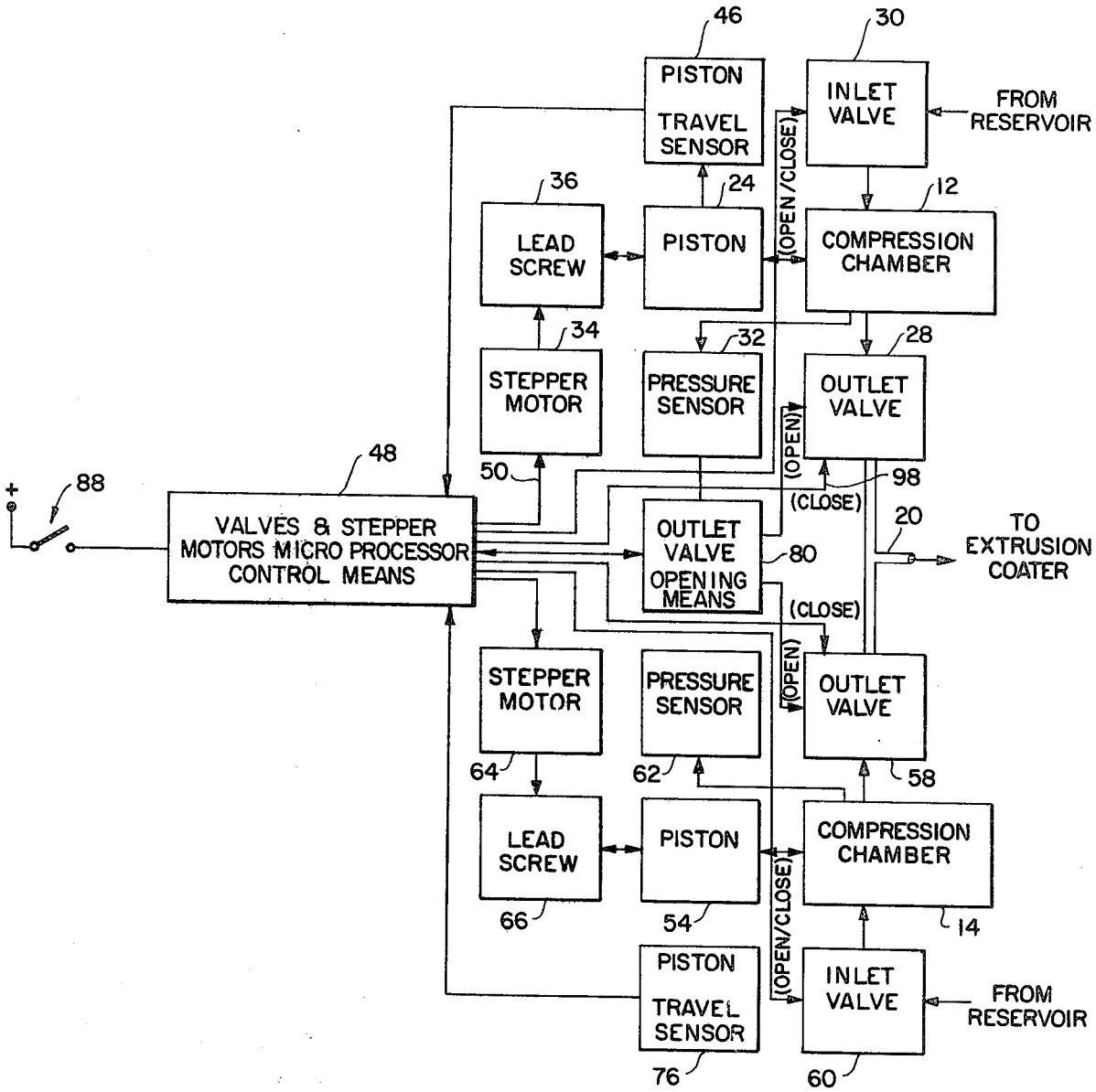
FIG. 2 is a signal flow functional block diagram of the control systems that control the pumping apparatus depicted in FIG. 1.
Figure 3:
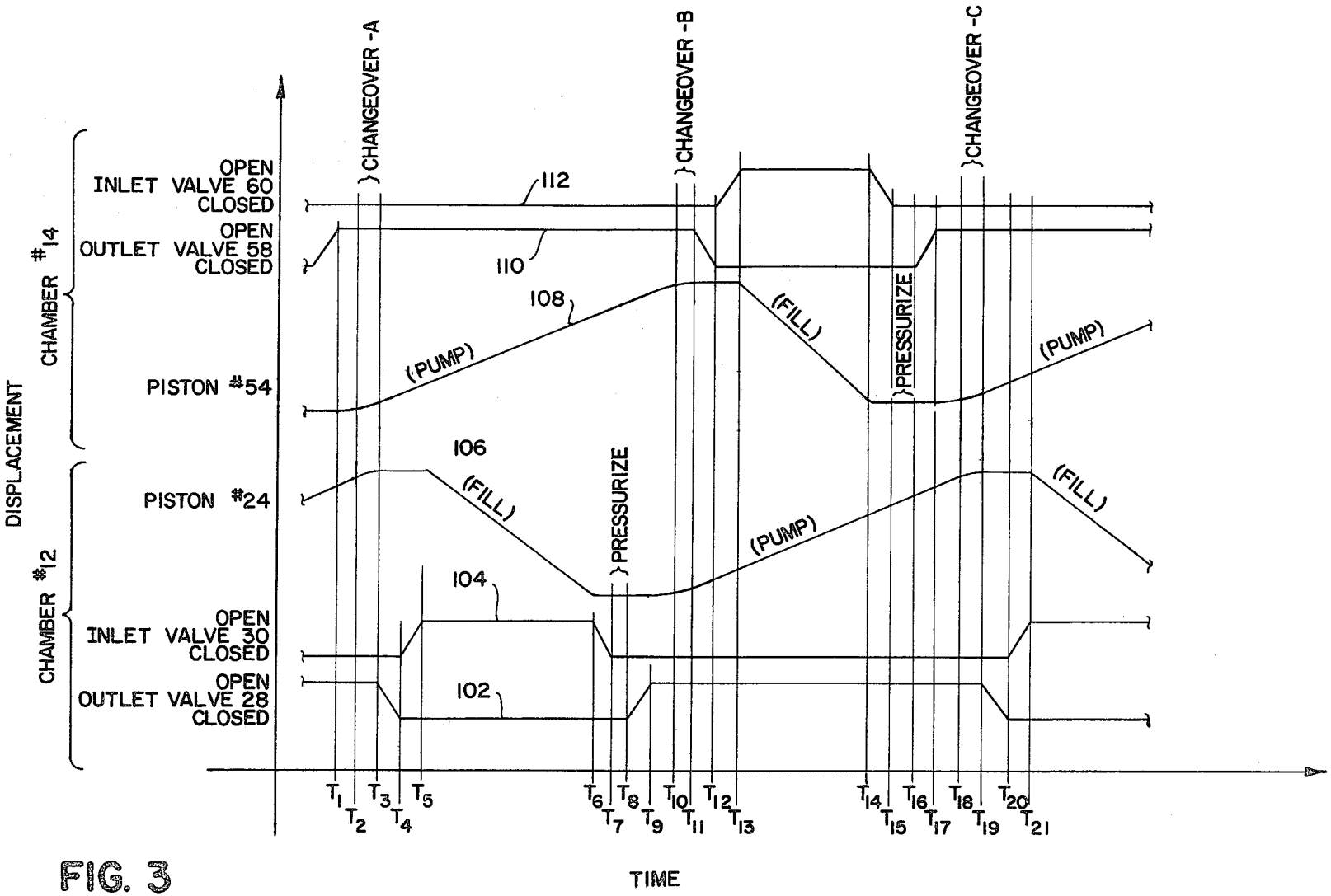
FIG. 3 is a time line showing the displacement and sequence of operation of the valves and pistons in the pumping apparatus of FIG. 1.

FIG. 2 is a signal flow block diagram of a control system for controlling the pumping apparatus of FIG. 1, and FIG. 3 is a time line showing the time and the extent of displacement of the input valves, output valves, and pistons in the pumping apparatus of said FIG. 1. In FIG. 3, the movement of outlet valve 28 and inlet valve 30 of pumping chamber 12 corresponds to traces 102 and 104, respectively; the movement of pistons 24 and 54 in cylinders 22 and 52, respectively, correspond to traces 106 and 108, respectively; and the movement of outlet valve 58 and inlet valve 60 of pumping chamber 14 correspond to traces 110 and 112, respectively, with all of said movements varying as a function of time.

A convenient starting point in the description of the sequence of operation of the pumping apparatus of FIG. 1 is to assume that outlet valves 28 and 58 are in the open position; that inlet valves 30 and 60 are in the closed position; that pumpable material 16 is being moved through outlet valve 28 of pumping chamber 12 into common conduit 20 by the upward movement of piston 24 within cylinder 22; and that pumping chamber 14 has been filled with material 16 and that this material has previously been pressurized to the same pressure as that of the material in said chamber 12. This condition occurs at time $T_1$ in the time line of FIG. 3.

Referring now to FIGS. 1, 2 and 3, and progressing from time $T_1$ to time $T_2$, at time $T_2$ upper limit microswitch actuator 42 actuates piston travel sensor 46 as it is moved to a preselected upper travel limit of piston 24 by the rotation of lead screw 36 in housing 38 and the rotation of stepper motor 34. The upper limit signal produced by said sensor 46 is routed to microprocessor control means 48 through path 50. Prior to time $T_2$, microprocessor control means 48 was transmitting a constant rate of pulses to stepper motor 34 through path 90 causing the constant rate of rotation of said stepper motor 34 and a corresponding constant rate of linear upward movement of piston 24 in cylinder 22, said piston 24 being coupled to said motor 34 as previously described. This upper limit signal is, in effect, instructions to microprocessor control means 48 that piston 24 is nearing the current limit of its ability to push material 16 through outlet valve 28 and into common conduit 20 and that it is time to change over to another source of material 16 and means for moving same into said common conduit 20.

Upon receipt of said upper limit signal by microprocessor control means 48 at time $T_2$, said control means 48 starts reducing the number of pulses that it is transmitting to stepper motor 34 which reduces the rate of upward movement of piston 24, and simultaneously, and to the same extent, starts sending pulses to stepper motor 64 through path 92 in accordance with preprogrammed instructions in said control means 48 causing said stepper motor 64 to start moving piston 54 upward until the rate of pulses being sent to stepper motor 34 has been reduced to zero and the rate of pulses being sent to stepper motor 64 has been increased by control means 48 to the pulse rate that was being applied to stepper motor 34 immediately prior to time $T_2$. More specific details of the times of occurrence and the rates of change of the pulses that are applied to stepper motors 34 and 64 by microprocessor control means 48 when changing from one pumping chamber combination to another, will be discussed below with reference to FIG. 4.

With continued reference to FIGS. 1, 2 and 3, at time $T_3$ changeover from pumping chamber 12 to pumping chamber 14 is complete in that all of the material 16 being supplied to common conduit 20 is being moved through pumping chamber 14 by the upward movement of piston 54 at said time $T_3$. In addition, at time $T_3$ microprocessor control means 48 sends a preprogrammed valve close signal through path 98 to initiate the closing of chamber 12 outlet valve 28. By operating outlet valve 28 when the pressures on each side of same are equal little, if any, shearing of the pumped material occurs which minimizes changes to the physical properties of the said pumped material.

At time $T_4$ said outlet valve 28 is fully closed and at that time microprocessor control means 48 sends a preprogrammed valve open signal through path 94 to initiate the opening of chamber 12 inlet valve 30. At time $T_5$ inlet valve 30 is fully opened and said time $T_5$ microprocessor control means 48 sends motor reverse signal pulses to stepper motor 34 through path 90 which reverses the rotational direction of stepper motor 34 and the linear direction of piston 24 mechanically coupled thereto. The reverse direction linear speed of piston 24 is approximately twice that of its upward or forward direction. Material 16 in reservoir 18 begins to flow through inlet valve 30 and into pressure chamber 12 and cylinder 22 under the influence of the pressure in reservoir 18 at said time $T_5$. A pressure head is maintained in reservoir 18 to prevent the collapse of rolling seal 26.

Just prior to time $T_6$ the downward or cylinder 22 filling movement of piston 24 is terminated by microprocessor control means 48 in response to a lower piston travel limit signal from piston travel sensor 46, and at said time $T_6$ said microprocessor control means 48 sends a preprogrammed valve close signal through path 94 to initiate the closing of chamber 12 inlet valve 30. In this the preferred embodiment, the downward or cylinder filling movement of piston 24 is approximately twice the rate of its upward or material 16 pumping movement. At time $T_7$ inlet valve 30 has fully closed and at said time $T_7$ microprocessor control means 48 sends a preprogrammed sequence of pulses to stepper motor 34 to cause said motor 34 to move piston 24 upward and compress the material 16 within pumping chamber 12 if the pressure in pumping chamber 12 is less than the pressure in pumping chamber 14 as determined by outlet valve opening means 80, information that is routed to said microprocessor control means 48 through path 86. When the pressure in said pumping chamber 12 is equal to the pressure on material 16 in pumping chamber 14 as determined by pressure sensors 32 and 62 and outlet valve opening means 80, which occurs at time $T_8$, a signal indicating such pressure equalization is sent to microprocessor control means 48 by outlet valve opening means 80 through path 86 which causes said control means 48 to terminate the pressurizing rotation of stepper motor 34 and to initiate the opening of outlet valve 28 once such stepper motor 34 rotation has been terminated. Outlet valve 28 is opened when the pressures on both sides are equal, which minimizes shearing of the pumped material. At time $T_9$ outlet valve 28 has fully opened and stepper motor 34 is in a quiescent state waiting for a series of pulses from microprocessor control means 48 that will cause said stepper motor 34 to rotate and move piston 24 upward in cylinder 22 and push material 16 within pumping chamber 12 through outlet valve 28 and into common conduit 20.

At time $T_{10}$ upper limit microswitch actuator 72 actuates piston travel sensor 76 as it is moved to a preselected upper travel limit of piston 54 by the rotation of lead screw 66 in housing 68 and the rotation of stepper motor 64. The upper limit signal produced by said sensor 76 is routed to microprocessor control means 48 through path 78. Immediately prior to time $T_{10}$, control means 48 was transmitting a constant rate of pulses to stepper motor 64 through path 92 causing a constant rate of rotation of said stepper motor 64 and a corresponding constant rate of linear upward movement of piston 54 in cylinder 52, said piston 54 being coupled to said motor 64 as previously described. The upper limit signal produced by piston travel sensor 76 notifies control means 48 that piston 54 is near the current limit of its ability to push material 16 through outlet valve 58 and into common conduit 20, and that it is time to change over to another source of said material 16 and means for moving same into said common conduit 20.

Upon receipt of the upper limit signal from piston travel sensor 76 by microprocessor control means 48 which occurs at time $T_{10}$, said control means 48 starts reducing the number of digital pulses that it is transmitting to stepper motor 64 which reduces the rate of upward movement of piston 54, and simultaneously, and to the same extent, start sending pulses to stepper motor 34 through path 90 in accordance with preprogrammed instructions in said control means 48 causing said stepper motor 34 to start moving piston 24 upward until the rate of pulses being sent to stepper motor 64 has been reduced to zero and the rate of pulses being sent to stepper motor 34 has been increased by control means to the pulse rate that was being applied to stepper motor 64 immediately prior to time $T_{10}$.

At time $T_{11}$ changeover from pumping chamber 14 to pumping chamber 12 is complete in that all of the material 16 being supplied to common conduit 20 is being moved through pumping chamber 12 by the upward movement of piston 24 at said time $T_{11}$. In addition, at time $T_{11}$, microprocessor control means 48 sends a preprogrammed valve close signal through path 100 to initiate the closing of chamber 14 outlet valve 58. Outlet valve 58 is closed when the pressures on both sides are equal, which minimizes shearing of the pumped material.

At time $T_{12}$ outlet valve 58 is fully closed and at that time, microprocessor control means 48 sends a preprogrammed valve open signal through path 96 to initiate the opening of chamber 14 inlet valve 60. At time $T_{13}$ inlet valve 60 is fully opened and at said time $T_{13}$ microprocessor control means 48 sends a motor reverse signal to stepper motor 64 through path 92 which reverses the rotational direction of stepper motor 64 and the linear direction of piston 54 mechanically coupled thereto.

The reverse direction linear speed of piston 54 is approximately twice that of its upward or forward direction. Material 16 in reservoir 18 begins to flow through inlet valve 60 and into pumping chamber 14 under the influence of the pressure in reservoir 18 at said time $T_{13}$. A pressure head is maintained in the reservoir to prevent the collapse of rolling seal 56.

Just prior to time $T_{14}$ the downward or cylinder 52 filling movement of piston 54 is terminated by microprocessor control means 48 in response to a lower piston travel limit signal from piston travel sensor 76, and at said time $T_{14}$ said microprocessor control means 48 sends a preprogrammed valve close signal through path 96 to initiate the closing of chamber 14 inlet valve 60. At time $T_{15}$ inlet valve 60 has fully closed and at said time $T_{15}$ microprocessor control means 48 sends a preprogrammed sequence of pulses to stepper motor 64 to cause said motor 64 to move piston 54 upward to compress the material 16 within pumping chamber 14 if the pressure in pumping chamber 14 is less than the pressure in pumping chamber 12 as determined by outlet valve opening means 80, information that is routed to said microprocessor control means 48 through path 86. When the pressure in said pumping chamber 14 is equal to the pressure on material 16 in pumping chamber 12 as determined by pressure sensors 32 and 62 and outlet valve opening means 80, which occurs at time $T_{16}$, a signal indicating such pressure equalization is sent to microprocessor control means 48 by outlet valve opening means 80 through path 86 which causes said control means 48 to terminate the pressurizing rotation of stepper motor 64 and to initiate the closing of inlet valve 60 once such stepper motor 64 rotation has been terminated. At time $T_{16}$ microprocessor control means 48 also initiates the opening of chamber 14 outlet valve 58. Outlet valve 58 is opened when the pressures on both sides of same are equal, which minimizes shearing of the pumped material. At time $T_{17}$ outlet valve 58 has fully opened and stepper motor 64 is in a quiescent state waiting for a series of pulses from microprocessor control means 48 that will cause said stepper motor 64 to rotate and move piston 54 upward in cylinder 52 and push material 16 within pumping chamber 14 through outlet valve 58 and into common conduit 20.

At time $T_{18}$ another changeover from chamber 12, stepper motor 34/piston 24 to chamber 14, stepper motor 64/piston 54 is initiated by the actuation of piston travel sensor 46 by upper limit microswitch actuator 42. The sequence of operations that occur at times $T_{18}$, $T_{19}$, $T_{20}$ and $T_{21}$ are the same as the sequence of operations that occur at times $T_2$, $T_3$, $T_4$ and $T_5$, respectively. Changeovers in the manner described from times $T_1$ through $T_{21}$ from the pumping and filling apparatus associated with chamber 12 to the pumping and filling apparatus associated with chamber 14, and vice versa, will continue so long as the above-described pumping apparatus of the present invention continues to operate in the manner described above.

Figure 4:
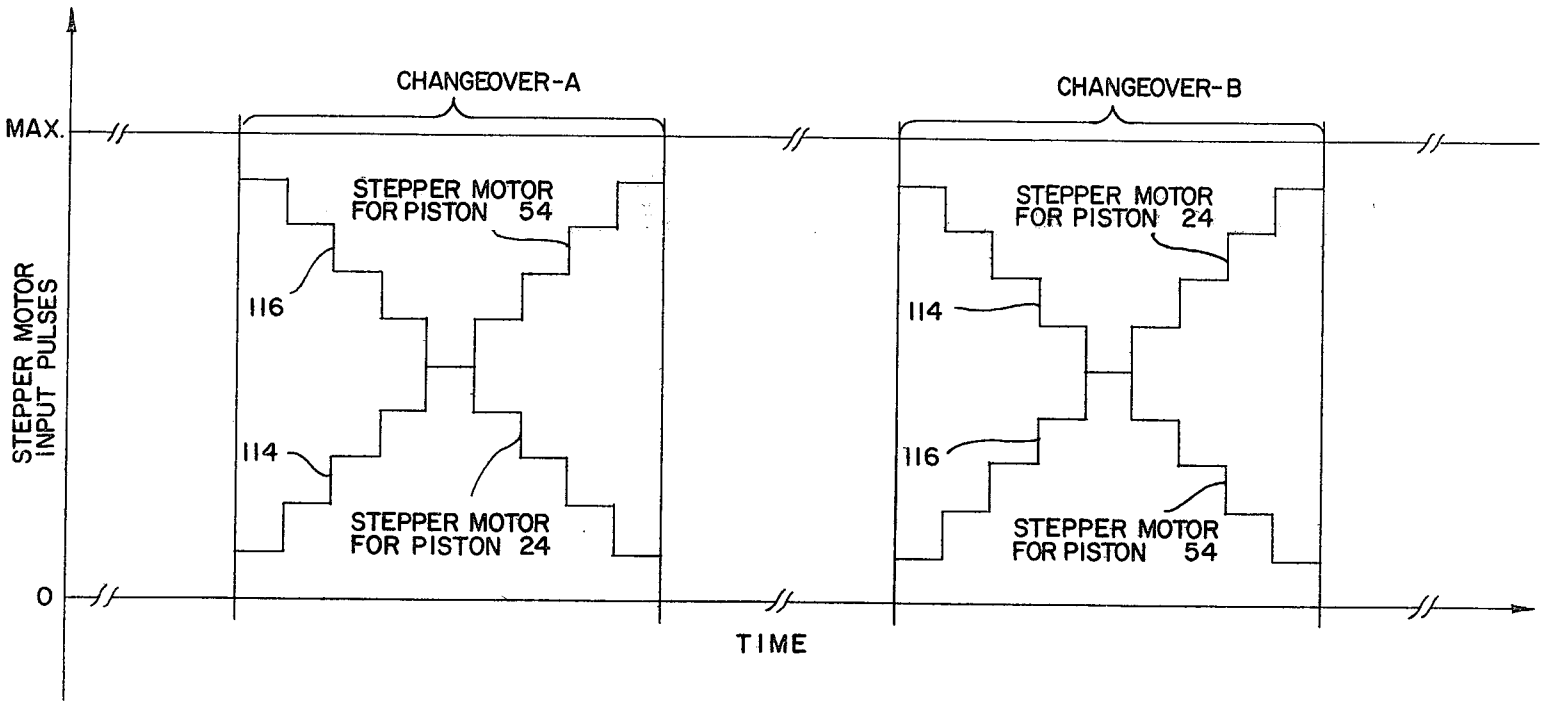
FIG. 4 is a simplified time line of stepper motor movement of each of the stepper motors of FIG. 1 during two pumping chamber changeovers.

In FIG. 4, two traces, 114 and 116, show the times of occurrence and the rates of change of the pulses that are applied to stepper motors 34 and 64 by microprocessor control means 48 when changing from one pumping chamber to another. These two changeover sequences are designated changeover A and changeover B in both FIGS. 3 and 4. Referring now to FIGS. 3 and 4, during changeover A, the rotational speed of stepper motor 34 and the linear speed of piston 24 which is mechanically coupled to said stepper motor 34 are reduced from a maximum rate of speed to zero and the rotational speed of stepper motor 64 and the linear speed of piston 54 which is mechanically coupled to said stepper motor 64 are increased from zero to their maximum rates of speed. At any point in time during either changeover A or changeover B, the sum of the pulses being applied to both stepper motors 34 and 64 is always equal to the number of pulses being applied to either stepper motor 34 or stepper motor 64 immediately before or immediately after said changeovers A or B. During changeover A, every time an input pulse is added to the input of stepper motor 64 (piston 54), an input pulse is simultaneously subtracted from the input to stepper motor 34 (piston 24) until the rate of rotation of stepper motor 34 is reduced to zero and the rate of rotation of stepper motor 64 has increased to what the rate of rotation of stepper motor 34 was immediately prior to the occurrence of changeover A. Also, during changeover B, every time an input pulse is added to the input of stepper motor 34 (piston 24), an input pulse is simultaneously subtracted from the input to stepper motor 64/piston 54 until the rate of rotation of stepper motor 64 is reduced to zero and the rate of rotation of stepper motor 34 has increased to what the rate of rotation of stepper motor 64 was immediately prior to the occurrence of changeover B.

DISCUSSION

Stepper motors are presently available that utilize 6,400 input pulses in order to generate a single stepper motor revolution. Stepper motors requiring 3,200 input pulses for one revolution are utilized in the preferred embodiment of the present invention. For convenience, only a very small fraction of the actual number of stepper motor pulses have been shown in the changeover portion of the traces depicted in FIG. 4. By utilizing a stepper motor requiring a high number of input pulses to a stepper motor revolution and simultaneously adding and subtracting pulses to at least a pair of such stepper motors in the manner described above, and by utilizing zero displacement outlet valves, only minimal flow rate variations are introduced into material 16 which makes it possible to deposit a uniform thickness of such material on a substrate such as a moving web.

A pair of cylinder/piston pumps have been described in the preferred embodiment of the pumping apparatus of the present invention. The present inventive concept also encompasses pumping apparatus that utilizes a plurality of such cylinders/pistons or any pumping apparatus where it is possible to simultaneously increase and decrease the pumping rates of pumping apparatus having overlapping compression cycles such that minimal pressure variations are introduced into the material being pumped.

Microprocessor control means 48 is a conventional programmable device that is able to store instructions and issue specific commands and/or pulses in accordance with said instructions when certain pump conditions such as chamber pressure or piston travel positions exist. Apparatus capable of functioning in the same manner as microprocessor control means 48 have been and are presently available in the marketplace.

The outlet valves described herein have been described as valves of the low shear, zero displacement type. While the structure of these valves does produce an extremely low amount of shear when actuated between their open and closed positions, the way in which these valves are operated has more of an effect on fluid shearing than the specific valve structure. As described above, outlet valves 28 and 58 are actuated between their open and closed position only after the pressures on both sides of said valves have equalized. While valve structure significantly reduces fluid shearing, it is the actuation of these valves between their open and closed position after such pressure equalization that has the greatest effect on the reduction of fluid shear.

The stepper motor/lead screw combination depicted in FIG. 1 is one in which the lead screw moves through the center of its associated stepper motor for proper piston movement. Less complex apparatus may be utilized when vertical space is not at a premium, apparatus where no linear movement occurs between the stepper motor and the lead screw. This apparatus would vary the coupling between the lead screw and its associated piston in order to achieve proper piston movement.

The terms "pumpable matter or material" as utilized herein means a liquid and/or a gas, or a slurry mixture.

It will be apparent to those skilled in the art from the foregoing description of our invention that various improvements and modifications can be made in it without departing from its true scope. The embodiments described herein are merely illustrative and should not be viewed as the only embodiments that might encompass our invention.

What is claimed is:

1. A pump comprising:

first and second pumping chambers, each of said chambers having an inlet, an outlet and a movable member for pressurizing a pumpable material within said chambers and for moving said material between an inlet and an outlet of their associated pumping chamber;

means for generating a signal representative of selected positions of each of said movable chamber members;

means for generating a signal representative of the pressure in each of said pumping chambers;

energizable first and second stepper motors, each of said motors having members that are rotatable in equal angular increments;

means for coupling said rotary motion of said first stepper motor to said movable first chamber member and for coupling said rotary motion of said second stepper motor to said movable second chamber member, each of said coupling means having the same mechanical advantage between their respective stepper motor and movable chamber member;

means responsive to said chamber pressure signal for interconnecting the outlet of one of said chambers with the outlet of the other of said chambers in a communicating relationship without displacing said pumpable material when the pressures in each of said chambers are equal; and means responsive to said movable chamber member position signal and to said chamber pressure signal for varying the rotational rate of each of said stepper motors such that incremental steps are simultaneously added to said first stepper motor and subtracted from said second stepper motor until the rate of rotation of said first stepper motor is reduced to zero and the rate of rotation of said second stepper motor is increased to the rotational rate of said first stepper motor immediately prior to the said simultaneous variation of the rates of rotation of said stepper motors, for selectively connecting said inlets of said pumping chambers to a source of pumpable material for subsequent movement of said material into a selected pumping chamber, for isolating said selected pumping chamber from said source of pumpable material after sufficient material has been moved into said selected pumping chamber by said movable chamber member, and for terminating the movement of said movable chamber member when the pressure in each of said pumping chambers are equal.

2. A pump comprising:

first and second pumping chambers, each of said chambers having an inlet, an outlet and a member displaceable for pressurizing and for moving a pumpable material between an inlet and an outlet of their associated pumping chambers;

means for generating a signal representative of first and second positions of each of said displaceable members;

means for generating a signal indicating that the pressures in each of said pumping chambers are equal;

means responsive to said pressure signal for connecting the outlet of each of said pumping chambers to a common conduit without displacing said pumpable material;

energizable first and second stepper motors, each of said stepper motors having an output member that moves in equal incremental steps;

means for coupling the incremental movement of said first stepper motor to the displaceable member of said first chamber, and for coupling the incremental movement of said second stepper motor to the displaceable member of said second chamber, each of said coupling means having the same mechanical advantage between their respective stepper motor and displaceable chamber member; and means responsive to the first position signal resulting from movement of said first displaceable member, indicating that it is approaching a movement limit, for simultaneously subtracting incremental movement steps from said first stepper motor and adding incremental steps to said second stepper motor until the rate of movement of said first stepper motor is reduced to zero and the rate of movement of said second stepper motor is increased to what the rate of movement of said first stepper motor was immediately prior to said simultaneous stepper motor movement, and for connecting the inlet of said first pumping chamber to a source of pumpable material after the rate of movement of said first stepper motor has been reduced to zero for subsequent movement of said material into said first chamber, responsive to the second position signal resulting from movement of said first displaceable member indicating that a sufficient quantity of pumpable material has been moved into said first pumping chamber by said first movable member, for closing said first chamber inlet and for changing the direction of said first stepper motor and said first displaceable member to pressurize said material within said first pumping chamber after said first pumping chamber outlet has been so closed, and responsive to said pressure signal for terminating the movement of said first displaceable member when the pressures in each of said pumping chambers are equal.

3. Apparatus according to claims 1 or 2, wherein said pumping chamber includes a cylinder and said movable member is a piston.

4. Apparatus according to claims 1 or 2, wherein said means responsive to said first and second position signals and to said pressure signal is microprocessor means capable of storing preprogrammed instructions that controls the opening and closing of said inlets, the opening and closing of said outlets and the rotation of said first and second stepper motors in accordance with selected pump conditions.

5. Apparatus according to claims 1 or 2, wherein said pumpable material is a liquid.

6. Apparatus according to claims 1 or 2, wherein said pumpable material is a gas.

7. Apparatus according to claims 1 or 2, wherein said pumpable material is a slurry.

8. A method of operating a pair of pumps in overlapping cycles to deliver pumpable materials from a source thereof to a common discharge conduit while maintaining a substantially constant flow rate of said material delivered through said common conduit, the method comprising the steps of:

(a) operating a first of said pumps to deliver said material through its outlet at a given delivery rate and a corresponding value of pressure to said discharge conduit while operating said second pump to induce a charge of material through its inlet;

(b) operating said second pump to compress the material therein to said corresponding pressure value;

(c) opening the outlet of said second pump while maintaining said corresponding pressure value in said second pump;

(d) operating said second pump to deliver its contained material to said discharge conduit at an increasing rate up to said given rate while operating said first pump to deliver its contained material at a decreasing rate substantially equally offsetting the increasing delivery rate of said second pump and thereby maintain a constant rate of delivery of material through said discharge conduit;

(e) closing the outlet of said first pump when the delivery rate thereof reaches zero and the delivery rate of said second pump reaches said given value;

(f) operating said first pump to induce through its inlet a charge of material;

(g) operating said first pump in the same manner as the second pump in steps (b), (c) and (d) and the second pump in the same manner as the first pump in steps (d), (e) and (f); and (h) continually repeating the overlapping pump cycles as set forth in steps (b) through (g).

9. A pump comprising:

a pair of pumping chambers each having an inlet coupled to a source of pumpable material, an outlet coupled to a common discharge conduit, and pumping means actuatable at variable rates for withdrawing said material from said source to each chamber through its respective inlet and delivering said material through its respective outlet to said common discharge conduit;

means for generating a pressure signal representative of the pressure within each of said chambers;

means for generating a volume signal representative of a given volume within each of said pumping chambers; and control means responsive to said pressure signals and said volume signals for selectively blocking and unblocking said inlets and outlets and for actuating said pumping means through partially overlapping material delivery cycles in which material is continuously delivered to common discharge conduit at a substantially constant flow rate with alternate delivery from each of said pumping means at said constant rate and overlapping delivery from both at offsetting rates to maintain said constant flow rate during changeover from the pumping means of one chamber to the other, said control means including means operative at said changeover for actuating the pumping means of the said other pumping chamber to deliver material to said discharge conduit at an incrementally increasing rate while actuating the pumping means of the said one pumping chamber to deliver material to said discharge conduit at a rate decreasing in increments substantially equal to those of said increasing rate until the rate of delivery of material from said other chamber equals said constant flow rate and the rate of delivery of material from said one chamber is reduced to zero.

10. The pump of claim 9 wherein said volume signal is representative of a given reduced volume of material within a given chamber, and said control means includes means for initiating said changeover by unblocking the outlet of said other chamber and actuating said pumping means of both said chambers at said offsetting rates responsive to equal pressure signals from both said chambers and said volume signal from said one chamber and for terminating said changeover by blocking the outlet of said one chamber and maintaining the actuation of said pumping means of said other pumping chamber constant responsive to actuation of the pumping means of said one chamber to zero.

11. Pump apparatus for delivering material from a source thereof to a common discharge conduit at a substantially constant rate, said pump apparatus comprising:

a pair of pumps, each having a pumping chamber with an inlet coupled between said source of material and the chamber, an outlet coupled between said common discharge and the chamber, a movable member displaceable within the chamber, and independent drive means coupled to said movable member and operative for displacing said member at an incrementally variable rate for drawing material from the chamber inlet and delivering it to the chamber outlet;

pressure sensing means for sensing the pressure within each of said chambers;

displacement sensing means for sensing the position of said movable member within each respective chamber; and control means responsive to said pressure sensing means and said displacement sensing means for selectively blocking and unblocking said inlets and outlets and for operating said independent drive means to actuate said pumps through partially overlapping cycles in which material is delivered to said common discharge conduit at said constant flow rate with alternate delivery from each of said pumps at said constant flow rate and offsetting overlapping delivery from both to maintain said constant flow rate during changeover from one pump to the other, said control means including means operative at said changeover from one pump to the other for operating the drive means of said one pump at an incrementally decreasing rate while operating the drive means of said other pump at a rate increasing in increments substantially equal to that of said decreasing rate to provide increasing delivery of material from said other pump in continuously offsetting relation to the decreasing delivery of material from said one pump and thereby maintain said constant flow rate within said discharge conduit.

12. The pump apparatus of claim 11 wherein said control means includes means, when said one pump is delivering material to said discharge conduit at said constant rate, for operating said drive means of said other pump to initially withdraw material from said source to the chamber of said other pump and then pressurize said withdrawn material to a pressure substantially equal to that of material within said one pump, said control means including means, responsive firstly to said pressure sensing means indicating that said equal pressure has been achieved and responsive secondly to said displacement sensing means indicating that said movable member of said one pump has reached a given position indicative of a reduced volume of remaining material, for initiating changeover to said other pump by first unblocking the outlet thereof and then incrementally decreasing the rate of displacement of said movable member of said one pump while initiating said incremental increasing displacement of said movable member of said other pump, and said control means further including means for terminating said changeover by blocking the outlet of said one pump reponsive to decreasing of the rate of displacement of said movable member of said one pump to zero.

* * * * *